United States Patent [19]

Rees et al.

[11] Patent Number: 4,533,979

[45] Date of Patent: Aug. 6, 1985

[54] FULL-FRAME FLASH ILLUMINATION SYSTEM

[75] Inventors: James D. Rees, Pittsford; Robert W. Gundlach, Victor; Jerome E. May, Rochester, all of N.Y.

[73] Assignee: Xerox Corporation, Stamford, Conn.

[21] Appl. No.: 608,300

[22] Filed: May 8, 1984

[51] Int. Cl.[3] ..... G09F 13/04

[52] U.S. Cl. ..... 362/97; 362/98; 355/67; 355/68; 355/69

[58] Field of Search ..... 362/97, 98, 263; 355/67, 68, 69, 70, 120

[56] References Cited

U.S. PATENT DOCUMENTS

| | | | |
|---|---|---|---|
| 3,850,523 | 11/1974 | Skavnak | 362/97 |
| 4,190,347 | 2/1980 | Siegmund | 355/67 |
| 4,250,538 | 2/1981 | Durbin et al. | 362/97 |
| 4,334,767 | 6/1982 | Lehman | 355/68 |
| 4,335,421 | 6/1982 | Modia et al. | 362/97 |
| 4,435,064 | 3/1984 | Tsukada et al. | 355/70 |
| 4,472,046 | 9/1984 | Kohyama | 355/68 |

*Primary Examiner*—Raymond A. Nelli

[57] ABSTRACT

A full-frame flash illumination and imaging system wherein an illumination mechanism compensates for unwanted charge variations on a photoreceptor belt caused by reflections of the lens from the document platen. The area of the belt upon which the negative lens image is formed is predetermined and a controlled quantity of light is directed towards this area, either before, after, or during exposure, to reduce the charge level of the area, to the degree necessary to compensate for the negative lens image. Several illumination mechanisms are disclosed including a programmable LED array and various mask configurations.

5 Claims, 3 Drawing Figures

FULL-FRAME FLASH ILLUMINATION SYSTEM

BACKGROUND OF THE INVENTION

The present invention relates generally to an illumination system in a document reproduction machine and more particularly, to a full-frame flash illumination system contained within a light housing.

As demands for faster copying and duplicating have increased, conventional machines which scan documents in incremental fashion to provide a flowing image on a xerographic drum have proved inadequate. New high speed techniques have evolved which utilize flash exposure of an entire document (full-frame) and the arrangement of a moving photoconductor in a flat condition at the instant of exposure. Full efficiency of such systems has been realized by enclosing the illumination system within a light housing. The interior walls of such a housing may be diffusely or specularly reflective to produce multiple reflection of light emanating from the illumination source contained within the housing. A uniform level of illumination is produced at the object plane; generally a transparent platen upon which the document to be reproduced is positioned. U.S. Pat. No. 4,250,538 is representative of such systems.

In these prior art systems, the imaging lens is positioned within the floor of the light housing and, in a multi-magnification mode, is moved laterally and vertically to positions required by magnification changes. One problem with these prior art imaging systems is that an image of the lens face is reflected from the bottom surface of the transparent platen and is projected back through the lens onto the photoreceptor surface. This negative disc image is subsequently developed as part of the document image and, upon transfer to a recording sheet, appears as a relatively dark spot on the output copy. Various expedients have been tried to reduce this problem. For example, as disclosed in U.S. Pat. No. 4,250,538, the lens barrel is painted white to reduce the size of the reflected lens image.

It is therefore an object of the present invention to reduce or eliminate the "black hole" problem in full-frame flash-type systems. This object is accomplished, according to the invention by providing a flash illumination and optical imaging system for reproducing documents on an object plane onto a photoreceptor belt member comprising, in combination, a transparent object plane for supporting original documents to be reproduced, an enclosed document illumination housing positioned adjacent said object plane, illumination means positioned interior of said housing and adapted to be periodically pulsed to provide a generally uniform level of illumination at said object plane, a projection lens mounted in the bottom surface of said housing opposite said object plane, said lens adapted to project an image of said document onto said photosensitive belt, said projected image containing a superimposed image of the projection lens face as reflected from said object plane, and illumination means adapted to irradiate an area of said belt generally conforming to the area of said lens image.

DESCRIPTION

Figure 1:
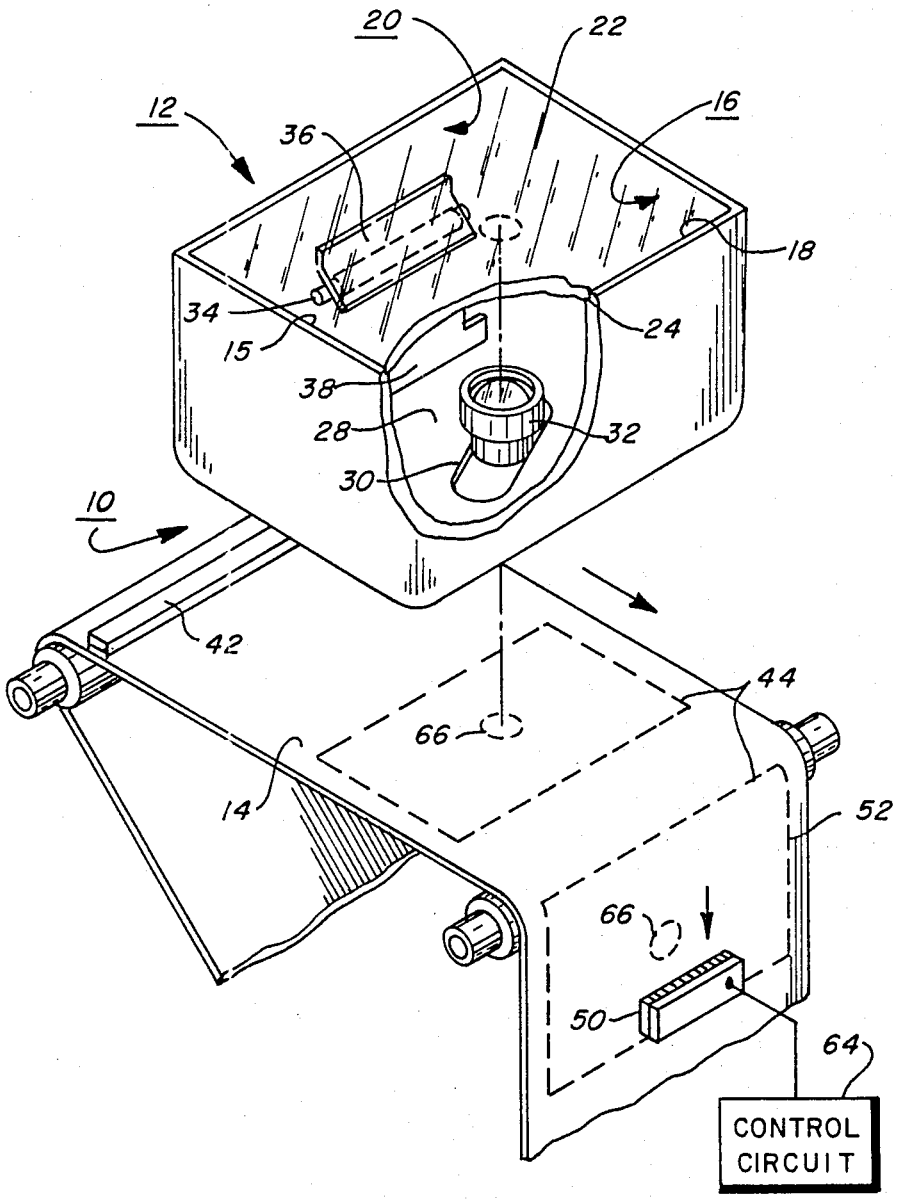
FIG. 1 is a partial perspective view of a full-frame illumination and imaging system showing a dark hole neutralization device positioned over the photoreceptor surface.

Referring to the drawings, FIG. 1 shows a document imaging system 10 which includes an integrating optical cavity 12 and a photoreceptor belt 14 (only a portion of which is shown). Cavity 12 is a completely enclosed housing, generally rectangular in shape, having a first pair of opposing side walls 15, 16 and a second pair of opposing side walls 18, 20. An upper, or top wall is formed by seating a glass platen 22 into aperture 24. The lower, or bottom wall 28 has an aperture 30 therein which accommodates a circular lens 32.

Mounted in the lower half of side wall 20 is flash illumination lamp 34 which may be, for example, a Xenon gas lamp. The lamp is connected to pulsing circuitry (not shown) which, when activated, pulses the lamp, resulting in an illumination flash of appropriate duration. The interior walls of the cavity have substantially diffusely reflecting surfaces which cause the flashed light to undergo multiple reflections from the walls, providing a uniform level of illumination at the underside of platen 22. Blockers 36 and 38 prevent direct light from reaching platen 22 and lens 32, respectively.

In operation, an original document to be copied (not shown) is placed on platen 22. Upon triggering of an illumination flash, the document is uniformly illuminated by the light, diffusely reflected from the cavity walls. The light rays are reflected from the document platen and are projected as a light image of the original document through lens 32 onto photoreceptor belt 14. The surface of belt 14 has been charged at a point prior to the exposure station to a uniform charge level by a corona generating device 42. As the light image of the document strikes the surface, informational areas are discharged to form an electrostatic latent image 44 conforming to the original document image. The belt is moved in the indicated direction, passing a low level illumination member which, in this embodiment is a LED array 50 comprising a series of light emitting diodes (LEDs) used for purposes discussed more fully below. As the belt continues its movement, the belt passes through a developing station (not shown) where the latent image is developed by coating it with a finely divided electrostatically attractable powder referred to as a "toner". Thus, a toner image is produced in conformity with a light image of the document being reproduced. Generally, the developed image is then transferred to a suitable transfer member such as paper and the image is fused. The specific mechanics for accomplishing the development transfer and fusing are not shown but are well known in the art.

Referring still further to FIG. 1, after lamp 34 has flashed, cavity 10 effectively acts as the light source. In addition to producing the original level of illumination at the document surface, the cavity also generates a stray light component which is reflected from the underside (and top) of the platen and is projected through the lens to discharge areas of the photoreceptor. In some systems, this stray light can be compensated for by increasing the amount of charge deposited on belt 12 by corona device 42 or by applying an anti-reflection coating to the underside and top of platen 22. However, a remaining problem is that the face of lens 32 is seen as a black disc in the image reflected from the bottom of the platen. That is, if viewed through the lens from a point on the photoreceptor surface, an inversely located cavity would be seen with a black disc at the upper "surface" corresponding to the lens location. This black disc is projected onto the surface of belt 14 forming a generally circular image area 66 approximately ½ the size of the actual lens (at 1:1 magnification) and having a higher charge level than desired. The edges of the image would be slightly out of focus. Image area 66 would thus be developed as an information area superimposed on either an actual image area or an area otherwise white (non-information) area. The developed "black hole" image would then be transferred to the recording paper resulting in an objectionable output copy. This is especially conspicuous if it happens to fall in a large light grey image area.

According to a first aspect of the invention, the area on the belt upon which the black disc image of the lens is projected is predetermined for a particular magnification mode. A programmable "erase" component such as LED array 50 is then positioned at an appropriate position above the belt and energized so as to reduce the charge level of that area of the sheet. FIG. 1 shows a portion of belt 14 with LED array 50 positioned above the belt at a point subsequent to (downstream) from the exposure zone. The array 50, comprised of a plurality of separately addressable LEDs $50_1$, $50_2$, $50_N$ is actuated by application of suitable control potentials from control circuit 64. The general operation and construction of these arrays is well known and described for example, in "Electronic Design" Sept. 27, 1966 at page 67 et seq. and in U.S. Pat. No. 3,967,893. Assuming a magnification of 1:1 has been selected, the precise location of image 66 has been predetermined and control circuit 64 has been programmed to separately actuate those LEDs required to direct radiation onto the disc area 66 as it passes beneath the array in the indicated direction. Thus, referring to FIG. 1, as the right hand edge of the disc begins to move beneath array 49 the central LEDs are initially activated. Further LEDs are actuated until the maximum dimension of the disc (roughly the diameter) is beneath the array. The diodes are subsequently and sequentially inactivated as the left side of the disc passes beneath the array. Thus, the surface area of disc 66 undergoes a charge reduction sufficient to compensate for the black disc imaging. As shown, LED array 50 extends over a significant portion of the belt width and can be addressed to discharge a disc area projected onto a different portion of the belt (for a magnification change) or a disc with different dimensions (again dependent on magnification). Array 50 can also be located upstream from the exposure zone so as to discharge the disc area prior to exposure.

Figure 2:
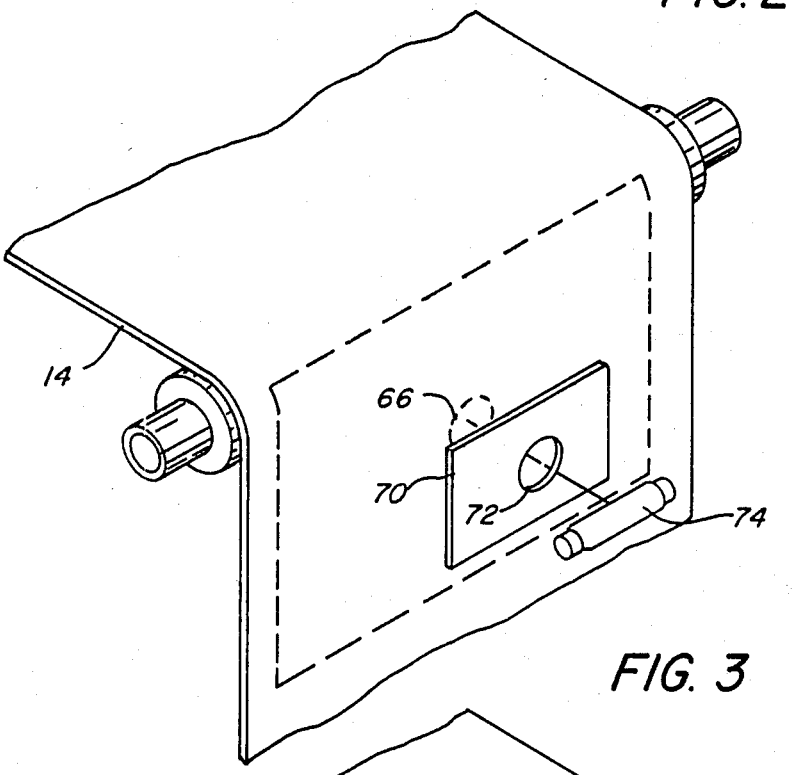
FIG. 2 shows a second embodiment of a neutralization device.

The negative image of the disc can be erased by other mechanisms than the LED array. For example, as shown in FIG. 2, a mask 70 or series of masks having an aperture 72 generally conforming to disc image 66 can be introduced between a light source 74 and belt 14 in the same location occupied by the LED array in FIG. 1. In this case, the light shown is pulsed at the precise point that the negative disc image underlies the mask aperture.

Alternatively, mask 70 can be adapted to have an aperture whose dimensions can be changed. For this technique the mask aperture would initially be completely closed until the negative disc image begins to pass beneath. The mask aperture would then progressively open from some central point outward and then progressively close again, simulating the action of the programmable LED array of FIG. 1. For this embodiment lamp 74 can be maintained in the energized state.

Figure 3:
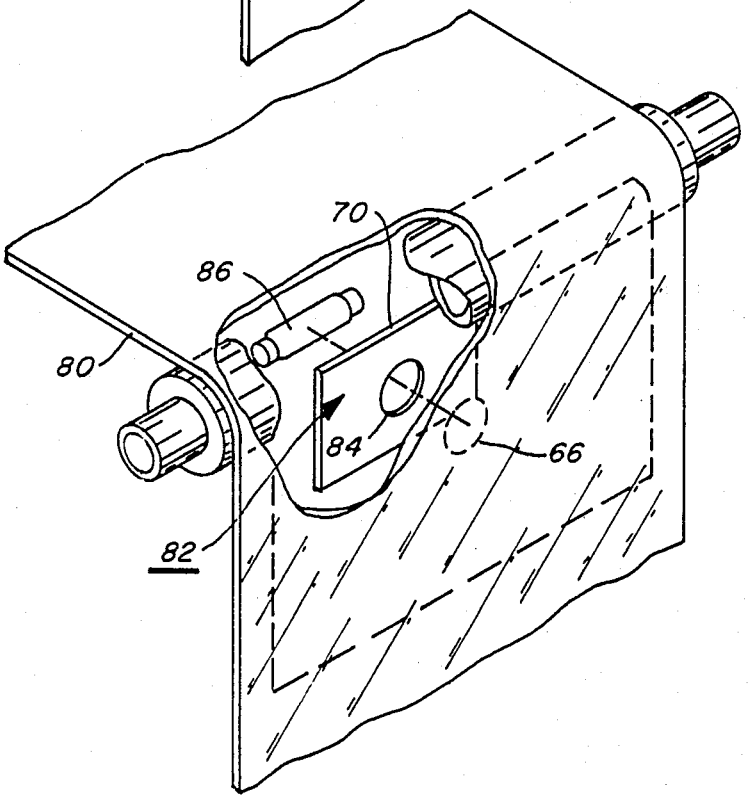
FIG. 3 shows a third embodiment of a neutralization device.

According to another embodiment of the present invention, a projected image of the black disc can be projected onto the photoreceptor during the actual image exposure. This embodiment is enabled when a transparent photoreceptor belt 80 is used as shown in FIG. 3. As shown, FIG. 3 shows a prespective view of the belt at the exposure station. A mask 82 with a disc aperture 84 therein is positioned beneath transparent photoreceptor belt 80. Lamp 86 is adapted to be energized at the same time and for the same duration as the document illumination lamp 34. This embodiment, as in the FIG. 2 embodiment, permits the illumination source to be positioned upstream or downstream from the exposure zone. Changes in disc image size and location can be similarly compensated for. For this embodiment, additional light may be required by lamp 34 to compensate for the substrate optical density.

While specific embodiments of the invention have been described, other changes or modifications are possible consistent with the principles of the present invention. For example, a laser scan system may be used to provide the required negative image illumination. Other light sources such as an LED array can be used with the FIG. 3 embodiment. And the array 50 of FIG. 1 can be made movable during a magnification mode to "trick" the disc image. All such modifications and changes are intended to be embraced by the following claims.

What is claimed is:

1. A flash illumination and optical imaging system for reproducing documents on an object plane onto a photoreceptor belt member comprising, in combination, a transparent object plane for supporting original documents to be reproduced, an document illumination housing positioned adjacent said object plane, a first illumination means positioned interior of said housing and adapted to be periodically pulsed to provide a generally uniform level of illumination at said object plane, a projection lens mounted in the bottom surface of said housing opposite said object plane, said lens adapted to project an image of said document onto said photosensitive belt member, said projected image containing a superimposed image of the projection lens as reflected from said object plane, and a second illumination means adapted to irradiate an area of said belt conforming to the area of said negative lens image.

2. The system of claim 1 wherein said illumination means is positioned above said belt at a position downstream from the exposure station.

3. The system of claim 1 wherein said illumination means comprises an LED array containing a plurality of separately addressable LEDs and control means to activate and deactivate said LEDs so as to irradiate an area of the belt conforming to the area of said negative lens image.

4. The system of claim 1 wherein said illumination means comprises a light source and a mask having an aperture conforming to the shape of said projected lens image, said mask introduced between said lamp and said photoreceptor belt.

5. The system of claim 1 wherein said belt is transparent and wherein said second illumination means is positioned beneath the exposure zone on the non-image forming surface of the belt, and wherein an optical mask having an aperture conforming to the negative lens image is positioned between said illumination source and said non-image forming surface of the belt and in opposing relation to the area of the belt surface upon which the image is formed during exposure.

* * * * *